US006514092B1

(12) United States Patent
Chiu

(10) Patent No.: US 6,514,092 B1
(45) Date of Patent: Feb. 4, 2003

(54) PS/2 CONNECTOR COMPATIBLE WITH S-TERMINAL LAYOUT

(75) Inventor: Fu-Chih Chiu, Taoyuan Hsien (TW)

(73) Assignee: Quanta Computer Inc. (TW)

( * ) Notice: Subject to any disclaimer, the term of this patent is extended or adjusted under 35 U.S.C. 154(b) by 0 days.

(21) Appl. No.: 10/158,828

(22) Filed: Jun. 3, 2002

(51) Int. Cl.[7] ..... H01R 12/00
(52) U.S. Cl. ..... 439/79; 439/83; 439/567
(58) Field of Search ..... 439/79, 83, 567

(56) References Cited

U.S. PATENT DOCUMENTS 4,975,550 A * 12/1990 Panchisin ..... 200/43.08
6,247,078 B1 * 6/2001 Ebert et al. ..... 710/102
6,302,731 B1 * 10/2001 Kring ..... 439/541.5

* cited by examiner

*Primary Examiner*—P. Austin Bradley
*Assistant Examiner*—Thuc Nguyen

(57) ABSTRACT

A PS/2 connector compatible with the printed circuit board layout of an S-terminal is described. The PS/2 connector can be mounted on a printed circuit board with an S-terminal layout. The PS/2 connector comprises a housing, six sockets, a dowel pin, two clicks and six modified pins. The six sockets connect with the peripheral device and transmit the signals. The dowel pin positions the PS/2 connector on a printed circuit board. The two clicks fix the PS/2 connector on the printed circuit board. The six modified pins can attach the S-terminal layout on the printed circuit board. Another aspect of the invention provides a selectable motherboard for utilizing the PS/2 connector with the S-terminal layout. The motherboard has a modified PS/2 connector, PS/2 circuits, a first switch, S-terminal circuits, and a second switch. The motherboard may turn on/off the first switch or second switch to control which circuits are used with the S-terminal layout on the motherboard.

14 Claims, 3 Drawing Sheets

PS/2 CONNECTOR COMPATIBLE WITH S-TERMINAL LAYOUT

FIELD OF THE INVENTION

The present invention relates to a PS/2 (Personal System/2 connector and especially to a PS/2 connector compatible with the printed circuit board layout of an S-terminal.

BACKGROUND OF THE INVENTION

Current computer functions are increasingly powerful and the multimedia applications are an important feature of the modem computer. The modem computer utilizes the mouse, keyboard and other devices to input commands and control the computer. The modem computer utilizes the input and output ports to obtain signals and data from other devices or other computers, and to deliver music, video images or other signals to the monitor and other display devices. The common input port for the mouse and the keyboard is a PS/2 port. A video image output port may utilize an S-terminal port or other port. The S-terminal (Super-Video Terminal) has long been a popular connector for transmitting image signals to the video device. Therefore, a lot of video devices support S-video signal with an S-terminal. In FIG. 1, a front view of one conventional S-terminal is depicted. The conventional S-terminal has seven pins, S1 to S7, to connect with the printed circuit board, and seven sockets to connect with the video device via an S-terminal cable. The PS/2 connector is a conventional connector to connect the mouse and the keyboard to the computer. FIG. 2 depicts a front view of a conventional PS/2 connector. A conventional PS/2 connector has six pins to connect with the printed circuit board and six sockets to connect with the mouse or keyboard.

Some computers need the S-terminal to transmit the video image to video devices for display. But some users don't need an S-terminal output port. To satisfy all users' requirements, the computer may provide both of the S-terminal and the PS/2 connector as the input/output ports for the user. In the portable computer, there is insufficient space for so many input/output connectors on the side panel and the printed circuit board. There is a need to satisfy all users and to solve the space problem of the portable computer.

SUMMARY OF THE INVENTION

One object of the present invention is to provide a modified PS/2 connector for mounting on a printed circuit board with an S-terminal layout.

Another object of the invention is to provide a selectable printed circuit board which provides selectable switches to control the working circuits, the PS/2 circuits or S-terminal circuits In a first aspect, the invention provides a PS/2 connector compatible with an S-terminal layout. The PS/2 connector transmits signals to a peripheral device and receives signals from the peripheral device. The PS/2 connector comprises a housing, six sockets, a dowel pin, two clicks and six modified pins. The housing may be made of plastic material. The six sockets mounted in the hosing connect with the peripheral device and transmit the signals. The dowel pin is a pin to position the PS/2 connector on a printed circuit board. The two clicks fix the PS/2 connector on the printed circuit board. The six modified pins attach to the S-terminal layout on the printed circuit board.

In a second aspect, the invention provides a selectable motherboard for utilizing a PS/2 connector to transmit signals on the selectable motherboard with an S-terminal layout. The selectable motherboard has a modified PS/2 connector, PS/2 circuits, a first switch, S-terminal circuits, and a second switch. The PS/2 circuits printed on the motherboard electrically connect with the S-terminal layout and are controlled by the first switch. The S-terminal circuits printed on the motherboard electrically connect with the S-terminal layout on the motherboard and are controlled by the second switch.

Hence, the computer becomes a computer with PS/2 connector when the PS/2 connector according to the present invention is soldered on the printed circuit board and the PS/2 circuits is turned on. The computer becomes a computer with an S-terminal to transmit video image to the display device if an S-terminal is soldered on the printed circuit board and the S-terminal circuits is turned on. The dimensions of the portable computer may be reduced; especially if the computer is a palm computer. The output connector of the computer may be diversified.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 2:
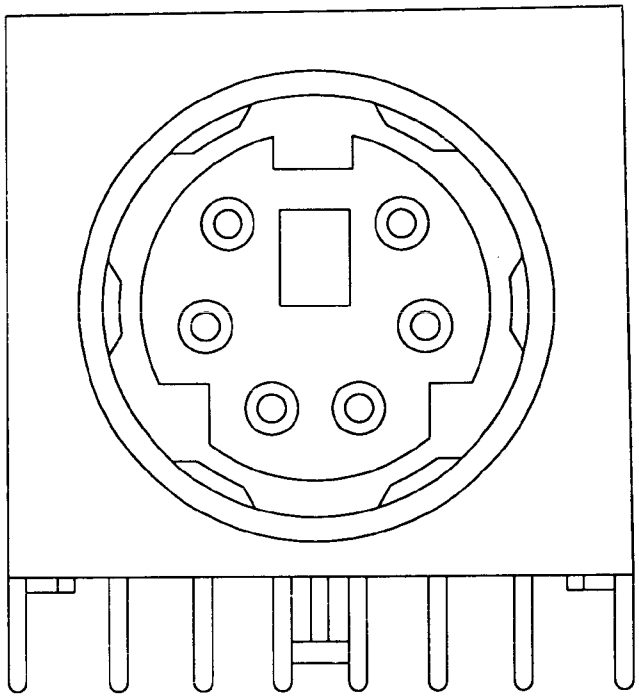
FIG. 2 (PRIOR ART)
FIG. 2 is a front view of a conventional PS/2 connector.
Figure 1:
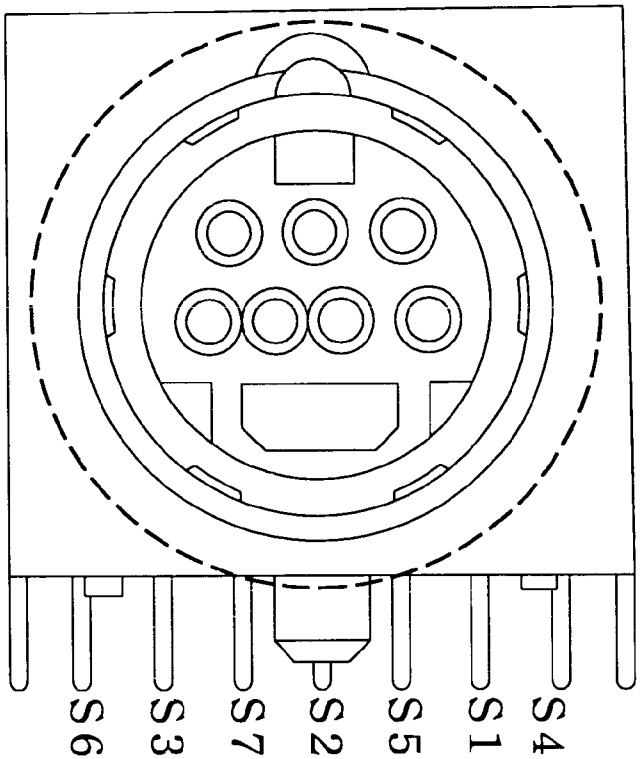
FIG. 1 (PRIOR ART)
FIG. 1 is a front view of a conventional S-terminal.

FIGS. 3A to 3D are different views of the PS/2 connector according to the present invention is depicted. The PS/2 connector according to the present invention includes six pins 310, P1–P6, six sockets 308, a housing 312, a pair of clicks 302, and a dowel pin 304. The six pins 310 are set on the bottom of the housing 312. The housing 312 is a cuboid. The six sockets 308 are on the front face of the housing 312 and are arranged in a circle. The sockets 308 and the appearance dimensions of the housing 312 are the same as the conventional product so that the mouse and the keyboard can connect with the computer. Therefore, the PS/2 connector according to the present invention guarantees that the computer links with the peripheral device in the normal fashion.

Figure 3A:
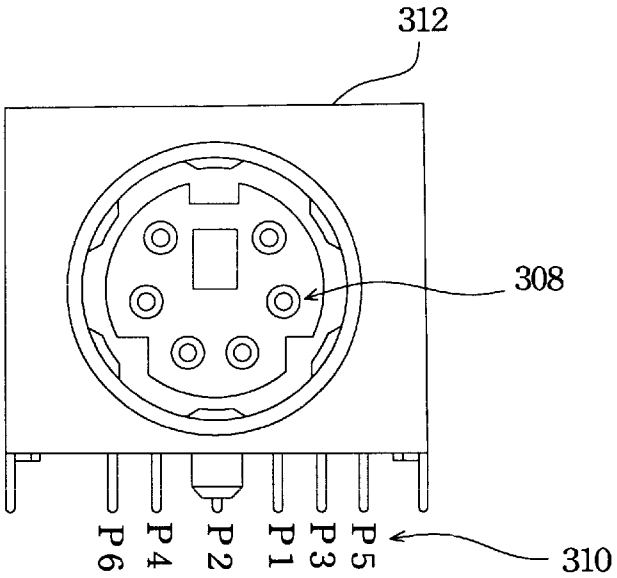
FIGS. 3A–3D are different views of the PS/2 connector according to the present invention.
Figure 3B:
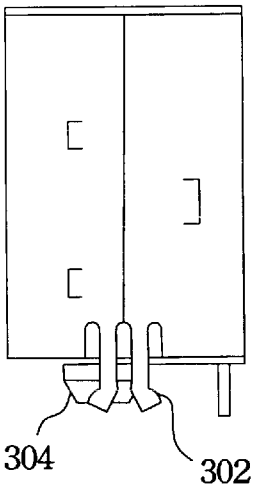
Figure 3C:
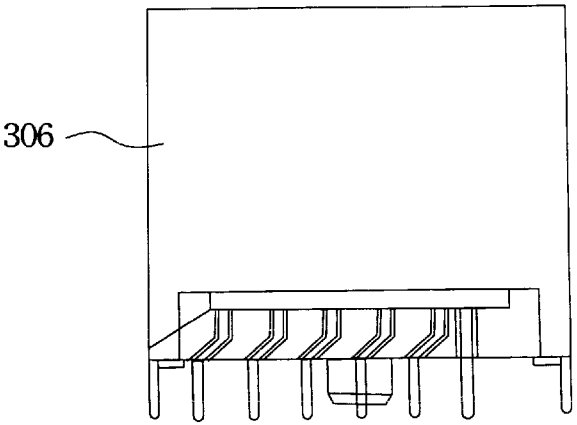
Figure 3D:
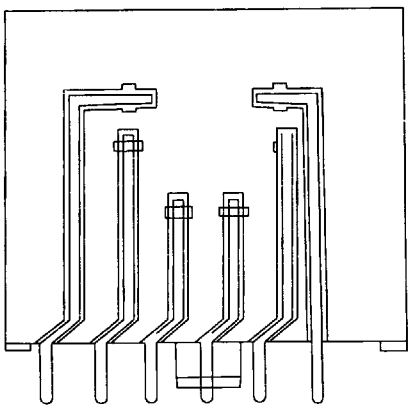

FIG. 3A is a front view of the PS/2 connector according to the present invention. When compared with FIG. 2, the pins 310 of the PS/2 connector according to the present invention are modified to shift about a half pitch. The six pins transmit signals from the motherboard to the sockets and then transmit to the peripheral device or in the reverse direction. To be compatible with the S-terminal layout, the pins and related components of the PS/2 connector according to the present invention need to have mechanical dimensions similar to those of the S-terminal. Referring to FIG. 3A, the six pins 310 protrude from the bottom of the housing 312. There are unequal pin numbers on the opposite sides of the bottom. For example, if the pins 310 are modified to shift right about a half pitch in the front view. One of the six pins 310 is set in the center of the bottom. Two of the six pins 310 and three of the six pins 310 are accordingly set on the opposite sides of the bottom. That is, two of the six pins 310 are set on the left side of the bottom in the front view. Three of the six pins 310 are set on the right side of the bottom in the front view. FIG. 3B illustrates a side view of the PS/2 connector according to the present invention. The PS/2 connector according to the present invention has a pair of clicks 302, a dowel pin 304 and pins 310 positioned similar to those of the S-terminal. FIG. 3C illustrates the back view of the PS/2 connector according to the present invention. The pins of the PS/2 connector according to the present invention are modified to shift about a half pitch, and therefore the modified pins may match the positions of the pads on the printed circuit board for the S-terminal. FIG. 3D illustrates a back view of the PS/2 connector, without a back cover 306, according to the present invention. The drawing provides clarification as to how the pins of the PS/2 connector should be modified to match the positions of the pads. Accordingly, the PS/2 connector according to the present invention may be attached on the printed circuit board at the position of the S-terminal.

Figure 4:
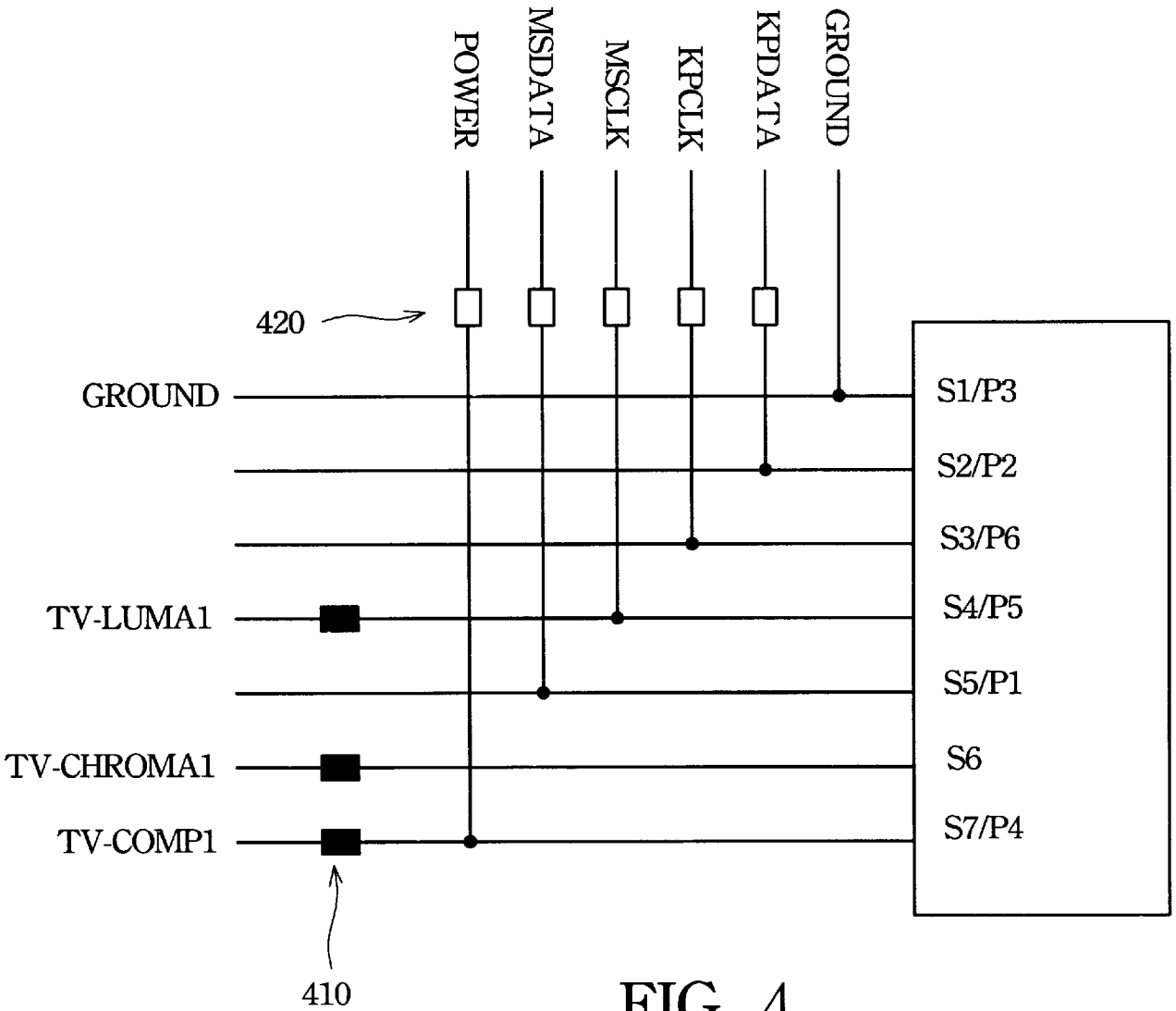
FIG. 4 is a sketch of a selectable circuit diagram of the PS/2 connector according to the present invention and a conventional S-terminal.

Referring to FIG. 4, a sketch circuit diagram of the PS/2 connector according to the present invention and a conventional S-terminal is shown. Of course, the functions and signals between the PS/2 connector and the S-terminal are different.

The functions of the S-terminal are described as follows:

S1: ground;

S4: TV-luminance;

S6: TV-chromaticity;

S7: TV-composition; and

S2, S3, S5: null function, where S1, S2, S3, S4, S5, S6 and S7 represent the pins of the S-terminal.

The functions of the PS/2 connector are introduced as follows:

P1: mouse data;

P2: keyboard data;

P3: ground;

P4: power;

P5: mouse clock; and

P6: keyboard clock, where P1, P2, P3, P4, P5, and P6 represent the pins of the PS/2 connector.

The functions of the PS/2 and S-terminal are completely different. Consequently, a designed printed circuit board, for example a motherboard of a computer, with selectable circuits is used with the PS/2 connector according to the present invention. FIG. 4 is a sketch of a selectable circuit diagram of the PS/2 connector according to the present invention and a conventional S-terminal. As the drawing shown, the S1 and P3 utilize the same position on the S-terminal layout of the printed circuit board. S2 and P2 utilize the same position, S3 and P6 utilize the same position, S4 and P5 utilize the same position, S5 and P1 utilize the same position, and S7 and P4 utilize the same position on the S-terminal layout of the printed circuit board, respectively. But the PS/2 connector has only 6 pins and the S-terminal has 7 pins; therefore, one pin, S6, of the S-terminal has no matching pin on PS/2 connector. The switch 410, three black squares, may turn on/off the circuits of the S-terminal and the switch 420, five white squares, may turn on/off the circuits of the PS/2 connector. If a computer is requested to have a S-video output with the S-terminal, switch 410 turns on the circuits of S4, S6 and S7, and switch 420 turns off the circuits of P1, P2, P5, P6 and P7. After the S-terminal is soldered on the printed circuit board, the computer becomes a computer with an S-video output by the S-terminal. Oppositely, if a computer is requested to have a PS/2 connector, the switch 420 turns on the circuits of P1, P2, P5, P6 and P7, and the switch 410 turns off the circuits of S4, S6 and S7. After the PS/2 connector is soldered on the printed circuit board, the computer becomes a computer with the PS/2 connector. The switch may utilize a bead, a resistor, a mechanical switch or an electrical switch, all of which variations are included within the spirit and scope of the present invention.

When the PS/2 connector according to the present invention is soldered on the printed circuit board and the PS/2 circuits are turned on, the computer may utilize the mouse or keyboard by this PS/2 connector. If the computer is to be a computer with an S-terminal, the computer may utilize the S-terminal to transmit a video image to the display device. Hence, the computer may change the output port thereof at any time before the connector soldered. The manufacturer of the portable computer may design the same motherboard to be used in at least two types of computer. The space of the computer may be reduced on the printed circuit board to reduce the dimensions of the portable computer, especially if the computer is a palm computer. The output selection of the computer is consequently diversified.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A PS/2 connector compatible with a layout of an S-terminal on a printed circuit board for transmitting signals to a peripheral device and receiving signals from the peripheral device, the PS/2 connector comprising:

a housing;

six sockets mounted in the housing for connecting with the peripheral device to transmit and receive the signals;

a dowel pin coupling with the housing for positioning the PS/2 connector on the printed circuit board;

two clicks coupling with the housing for fixing the PS/2 connector on the printed circuit board; and six modified pins mounted on a bottom of the housing and electrically connecting with the sockets, the six modified pins attaching to the layout of the S-terminal for transmitting and receiving the signals.

2. The PS/2 connector of claim 1, wherein the six modified pins are arranged according to that there are unequal pin numbers on the opposite sides of the bottom.

3. The PS/2 connector of claim 1, wherein one of the six pins is set in the center of the bottom, two of the six pins and three of the six pins are set on the opposite sides of the bottom.

4. The PS/2 connector of claim 1, wherein the six modified pins comprise a P1 pin, a P2 pin, a P3 pin, a P4 pin, a P5 pin and a P6 pin to match with the layout of the S-terminal; and the P1 pin receives and transmits mouse data, the P2 pin receives and transmits keyboard data, the P3 pin is a ground pin, the P4 pin is a power pin, the P5 pin receives and transmits mouse clock signals, and the P6 pin receives and transmits keyboard clock signals.

5. The PS/2 connector of claim 4, wherein the S-terminal further comprises seven pins, an S1 pin, an S2 pin, an S3 pin, an S4 pin, an S5 pin, an S6 pin and an S7 pin; and the S1 pin is a ground pin, the S4 pin receives and transmits TV-luminance signals, the S6 pin receives and transmits TV-chromaticity signals, the S7 pin receives and transmits TV-composition signals, and S2, S3, S5 are null function pins.

6. The PS/2 connector of claim 5, wherein the P1 pin is same position as the S5 pin; the P2 pin is same position as the 82 pin; the P3 pin is same position as the S1 pin; the P4 pin is the same position as the S7 pin; the P5 pin is same position as the S4 pin; and the P6 pin is the same position as the S3 pin.

7. A selectable motherboard for utilizing a PS/2 connector to transmit and receive signals with a layout of an S-terminal on the selectable motherboard, the selectable motherboard comprising:

a modified PS/2 connector, wherein the modified PS/2 connector comprises, a housing, six sockets mounted in the housing for connecting with a peripheral device to transmit and receive the signals, a dowel pin coupling with the housing for positioning the PS/2 connector on the selectable motherboard, two clicks coupling with the housing for fixing the PS/2 connector on the selectable motherboard, and six modified pins mounted on a bottom of the housing and electrically connecting with the sockets, the six modified pins attaching to the layout of the S-terminal for transmitting and receiving the signals;

PS/2 circuits printed on the selectable motherboard wherein the PS/2 circuits electrically connect with the layout of the S-terminal on the selectable motherboard;

a first switch turning on the PS/2 circuits for connecting with the PS/2 connector;

S-terminal circuits printed on the selectable motherboard wherein the S-terminal circuits electrically connect with the layout of the S-terminal on the selectable motherboard; and a second switch turning off the S-terminal circuits.

8. The PS/2 connector of claim 7, wherein the six modified pins are arranged according to that there are unequal pin numbers on the opposite sides of the bottom.

9. The PS/2 connector of claim 7, wherein one of the six pins is set in the center of the bottom, two of the six pins and three of the six pins are set on the opposite sides of the bottom.

10. The selectable motherboard of claim 7, wherein the six modified pins comprise a P1 pin, a P2 pin, a P3 pin, a P4 pin, a P5 pin and a P6 pin to match with the layout of the S-terminal; and the P1 pin receives and transmits mouse data, the P2 pin receives and transmits keyboard data, the P3 pin is a pin, the P4 pin is a power pin; the P5 pin receives and transmits mouse clock signals, and the P6 pin receives and transmits keyboard clock signals.

11. The selectable motherboard of claim 10, wherein the first switch turns on the PS/2 circuits for connecting with the P1 pin, the P2 pin, the P4 pin, the P5 pin, and the P6 pin.

12. The selectable motherboard of claim 7, wherein the PS/2 connector is replaced by an S-terminal attaching to the layout of the S-terminal on the selectable motherboard, the first switch is turned off, and the second switch is turned on, enabling the selectable motherboard to output video images via the S-terminal.

13. The selectable motherboard of claim 12, wherein the S-terminal further comprises seven pins, an S1 pin, an S2 pin, an S3 pin, an S4 pin, an S5 pin, an S6 pin and an S7 pin; and the S1 pin is a ground pin, the S4 pin receives and transmits TV-luminance signals, the S6 pin receives and transmits TV-chromaticity signals, the S7 pin receives and transmits TV-composition signals, and S2, S3, S5 are null function pins.

14. The selectable motherboard of claim 12, wherein the second switch turns on the S-terminal circuits for connecting with the S4 pin, the S6 pin and the S7 pin.

* * * * *